US005143782A

United States Patent [19]

Morishima et al.

[11] Patent Number: 5,143,782

[45] Date of Patent: Sep. 1, 1992

[54] THERMAL TRANSFER RECORDING SHEET

[75] Inventors: Takashi Morishima, Tokyo; Yukichi Murata, Sagamihara; Tadashi Okabayashi; Yutaka Kawai, both of Kurashiki, all of Japan

[73] Assignee: Mitsubishi Kasei Corporation, Tokyo, Japan

[21] Appl. No.: 561,325

[22] Filed: Aug. 1, 1990

[30] Foreign Application Priority Data

Aug. 2, 1989 [JP] Japan ..... 1-200930

[51] Int. Cl.[5] ..... B41M 5/26

[52] U.S. Cl. ..... 428/327; 428/195; 428/331; 428/484; 428/488.1; 428/488.4; 428/913; 428/914; 428/328

[58] Field of Search ..... 428/195, 484, 488.4, 428/488.1, 331, 327, 913, 914, 328

[56] References Cited

U.S. PATENT DOCUMENTS 4,829,050 5/1989 Henzel et al. ..... 428/913
4,853,274 8/1989 Makishima et al. ..... 428/488.4

FOREIGN PATENT DOCUMENTS 0194106 10/1986 European Pat. Off. .

*Primary Examiner*—Patrick J. Ryan
*Assistant Examiner*—T. A. Powers
*Attorney, Agent, or Firm*—Oblon, Spivak, McClelland, Maier & Neustadt

[57] ABSTRACT

A thermal transfer recording sheet comprising a base film, a heat transferable ink layer formed on one side of the base film and a heat resistant lubricating layer formed on the other side of the base film, wherein said heat resistant lubricating layer comprises round particles, fine particles having a particle size smaller than that of the round particles and a heat resistant binder resin, as the main components, and the round particles are projecting from the standard surface of the heat resistant lubricating layer.

8 Claims, 1 Drawing Sheet

THERMAL TRANSFER RECORDING SHEET

Figure 1:
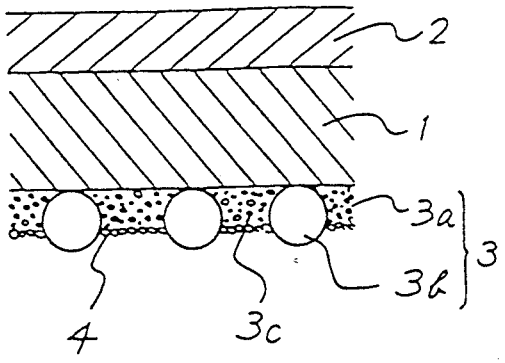

The present invention relates to a thermal transfer recording sheet. Particularly, it relates to a thermal transfer recording sheet which is advantageously useful for color recording of television images or for color recording by terminals of office equipments such as facsimile machines, printers or copying machines.

For such color recording, various systems including electrophotography, ink jet and thermal sensitive transfer recording, are being studied. Among them, the thermal sensitive transfer recording system is advantageous over other systems in view of the easy maintenance and operations of the apparatus and low costs for the apparatus and supplies.

In the thermal sensitive transfer recording system, an image-receiving sheet is overlaid on the ink-coated side of a thermal transfer recording sheet having a colorant-containing ink coated thereon, and recording is conducted by heating the rear side of the thermal transfer recording sheet by a thermal head so that the colorant in the thermal transfer recording sheet is thereby transferred to the image-receiving sheet. Such a system includes a wax transfer recording system and a dye transfer recording system.

However, in a thermal sensitive transfer recording system of this type, the thermal transfer recording sheet is heated to a high temperature by a thermal head. If the heat resistance of the base film of the thermal transfer recording sheet is inadequate, the base film is likely to fuse and stick to the thermal head. By such fusion, a noise so-called a sticking noise is likely to be generated, or a dust is likely to deposit on the thermal head. If the fusion is more remarkable, running of the thermal head will be difficult, and recording will no longer be conducted. Therefore, it has been proposed to provide protective films of various heat resistant resins in order to improve the heat resistance of the base film (Japanese Unexamined Patent Publications No. 7467/1980 and No. 74195/1982), or to add heat resistant fine particles, lubricants or surfactants to such protective layers in order to further improve the running properties (Japanese Unexamined Patent Publications No. 146790/1980, No. 155794/1981 and No. 129789/1982).

However, in the recent recording method of this system, a higher energy than before is imparted to the thermal head for high speed recording, and a larger load is imparted to the thermal transfer recording sheet. Therefore, with the methods disclosed in the above Patent Publications, it is difficult to obtain adequate running properties of a thermal head. Especially in the case of the thermal transfer recording sheet for the dye transfer recording system, a high energy is required at the time of recording as compared with the thermal transfer recording sheet for the wax transfer recording system, and adequate running properties of a thermal head can not be obtained with the thermal transfer recording sheet treated by the conventional methods.

To solve this problem, it has been proposed to construct the heat resistant lubricating layer with a polymer binder and spherical organic fine particles to reduce the friction (Japanese Unexamined Patent Publication No. 145088/1988). However, in this method, the lubricating layer does not have a function of cleaning the thermal head, and when a foreign matter such as a dust has deposited on the thermal head, such a foreign matter can not be removed from the thermal head and used to give an adverse effect such as non-uniformity in the density of the transferred images.

It is an object of the present invention to provide a thermal transfer recording sheet which provides adequate running properties and which has an adequate function of cleaning the thermal head.

The present inventors have conducted extensive studies on the running properties of the thermal head and the cleaning function of the thermal transfer recording sheet, and as a result, have found it possible to obtain a thermal transfer recording sheet which is capable of providing excellent running properties for the thermal head even during the high energy recording and which at the same time is capable of maintaining the thermal head clean even when used for a long period of time. The present invention has been accomplished on the basis of this discovery.

Thus, the present invention provides a thermal transfer recording sheet comprising a base film, a heat transferable ink layer formed on one side of the base film and a heat resistant lubricating layer formed on the other side of the base film, wherein said heat resistant lubricating layer comprises round particles, fine particles having a particle size smaller than that of the round particles and a heat resistant binder resin, as the main components, and the round particles are projecting from the standard surface of the heat resistant lubricating layer. In the thermal transfer recording sheet of the present invention, the round particles are projecting from the standard surface of the heat resistant lubricating layer, whereby the friction of the thermal head is reduced, and the running properties are excellent. Besides, the heat resistant lubricating layer contains fine particles in the binder resin, and the fine particles provides an excellent function of cleaning the thermal head.

Now, the present invention will be described in further detail with reference to the preferred embodiments.

In the accompanying drawing, FIG. 1 is a schematic view illustrating a vertical cross section of a thermal transfer recording sheet according to one embodiment of the present invention.

As shown in FIG. 1, the thermal transfer recording sheet of the present invention comprises a heat transferable ink layer 2 formed on one side of a base film 1 and a heat resistant lubricating layer 3 comprising a binder resin 3*a*, round particles 3*b* and fine particles 3*c*, with the round particles projecting from the surface. In this specification, the surface constituted by fine particles present on the surface of the heat resistant lubricating layer is referred to as the standard surface 4 of the heat resistant lubricating layer. Further, in the present invention, the round particles 3*b* may not necessarily be spherical, and the term "round particles" generally refers to large particles having no sharp corners at least at the portions exposed on the standard surface of the heat resistant lubricating layer.

As the round particles and the fine particles for the present invention, various heat resistant particles of metal type, inorganic type or organic type, may be employed. For example, particles of metal oxides such as silica, titanium oxide, magnesium oxide, zinc oxide, iron oxide, alumina and chromium oxide, particles of metal salts such as calcium carbonate, barium carbonate, calcium sulfate and barium sulfate, metal powders such as aluminum powder, zinc powder, iron powder and copper powder, inorganic pigments such as zinc white, iron oxide red, cobalt blue, cadmium yellow, cadmium red, Berlin blue, chrome yellow, molybdenum red, zinc chromate, ultramarine blue, titanium white and carbon black, particles of metal sulfides, metal carbonates and metal nitrides such as zinc sulfide, silicon carbide, silicon nitride, particles of minerals such as kaolin, kaolinite, silica sand, diatomaceous earth and talc, particles of heat resistant resins such as polyimide, nylon, acrylamide, melamine, a urea resin, a benzoguanamine resin and a silicone resin, and various organic pigments particles, may be mentioned. Among these particles, spherical particles of a silicon resin, silica or a benzoguanamine resin, are particularly preferred as the round particles. The particle size of the round particles is preferably from 0.5 to 5 μm. It is particularly preferred that the particle size is larger than the thickness of the heat resistant lubricating layer after drying (in the present invention, the thickness of the heat resistant lubricating layer is meant for the layer comprising the binder resin and the fine particles i.e. the thickness to the standard surface) and at most 5 μm, since the round particles will then be projecting beyond the standard surface of the heat resistant lubricating layer without any special treatment.

With respect to the fine particles to be used in combination with the round particles, the shape is not particularly limited. Among the above-mentioned particles, fine particles of silica or titanium oxide are particularly preferred, since they provide excellent function of cleaning the thermal head. The particle size of such fine particles is at least not larger than the thickness of the heat resistant lubricating layer, preferably at most 1/10 of the particle size of the round particles, more preferably from 0.01 μm to 0.1 μm.

With respect to the amounts of these particles, the round particles are used preferably from 1 to 50 parts by weight, particularly from 5 to 20 parts by weight, per 100 parts by weight of the binder resin. The fine particles are used preferably in an amount of from 5 to 100 parts by weight, particularly from 10 to 50 parts by weight, per 100 parts by weight of the binder resin.

As the binder resin useful for forming the heat resistant lubricating layer, various heat resistant thermoplastic resins, thermosetting resins and radiation curable resins may be mentioned. Radiation curable resins are particularly suitable, since they have excellent heat resistance and facilitate the formation of the heat resistant lubricating layer. Such radiation curable resins can be formed by irradiating and polymerizing compounds having unsaturated bonds such as acryloyl groups or methacryloyl groups. However, polyfunctional acrylates represented by the following formula (I):

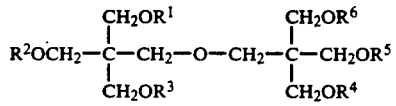

(I)

wherein each of $R^1$, $R^2$, $R^3$, $R^4$ and $R^5$ represents an acryloyl group or a methacryloyl group, and $R^6$ is an acryloyl group, a methacryloyl group, an alkyloyl group or a hydrogen atom, and epoxyacrylates represented by the following formulas (II) and (III):

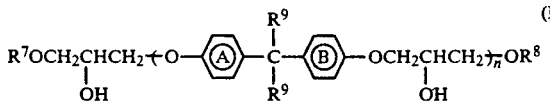

(II)

wherein each of $R^7$ and $R^8$ represents an acryloyl group or a methacryloyl group, each of $R^9$ and $R^{10}$ is a hydrogen atom, an alkyl group or an aryl group, each of rings A and B represents a benzene ring which may contain a lower alkyl group and/or a halogen atom as a substituent, and n is an integer of from 1 to 9,

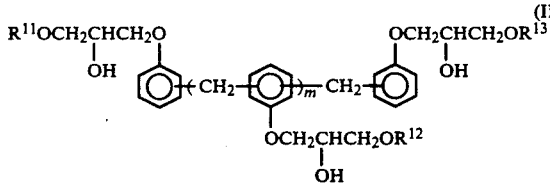

(III)

wherein each of $R^{11}$, $R^{12}$ and $R^{13}$ represents an acryloyl group or a methacryloyl group, and m is an integer of from 0 to 5, are particularly preferred.

The heat resistant lubricating layer can be formed by coating on a base film a coating solution comprising the above-mentioned round particles, fine particles and radiation curable compound, followed by drying and curing by irradiation with a radiation.

The coating solution may contain a solvent and a radical polymerization initiator, as the case requires. As such a solvent, various solvents such as alcohols, ketones, esters, aromatic hydrocarbons and halogenated hydrocarbons, may be employed. The polymerization initiator includes, for example, benzophenone, benzoin, benzoin ethers such as benzoin methyl ether and benzoin ethyl ether; benzylketals such as benzylmethyl ketal and benzylethyl ketal; azo compounds such as azobisisobutyronitrile; and organic peroxides such as benzoyl peroxide, lauryl peroxide, di-tert-butyl peroxide, dicumyl peroxide and cumene hydroperoxide. Such a polymerization initiator is used usually within a range of from 0.01 to 10% by weight relative to the binder resin monomer.

The coating solution may further contain a lubricant, a surfactant and an antistatic agent. By the incorporation of such agents, the running properties of the thermal transfer recording sheet will be improved, and generation of static electricity can be prevented, whereby deposition of a dust will be reduced, and the image quality of the record will be improved. Such lubricant, surfactant and antistatic agent may be those commonly employed as such. However, those having excellent heat resistance such as silicone type, fluorine type or phosphate type, are particularly suitable. The lubricant, the surfactant and the antistatic agent may suitably be added each in an amount of from 0.01 to 10% by weight relative to the total amount of the respective particles and the binder resin monomer. As a method for coating the above coating solution to be employed for the formation of the heat resistant lubricating layer, various methods may be mentioned including the methods employing a gravure coater, a reverse roll coater, a wire bar coater and an air doctor coater, as described in e.g. "Coating Methods" edited by Yuji Harasaki and published by Maki Shoten in 1979.

Here, to let the round particles project from the standard surface of the heat resistant lubricating layer, if the particle size of the round particles is larger than the thickness of the heat resistant lubricating layer, they may simply be coated. However, in a case where the particle diameter is smaller than the thickness of the heat resistant lubricating layer, it is necessary to employ some means during or after the coating, such as utilizing the difference in the specific gravity of the binder resin and the round particles, or applying an attracting force to the round particles, to obtain the projecting state. The coated layer of the above coating solution is dried to remove the solvent by a suitable means, followed by curing by a usual method such as heating or irradiating a radiation. As such a radiation, ultraviolet rays, electron beams or $\gamma$-rays may, for example, be mentioned. With respect to specific conditions for the curing, the heat curing is preferably conducted at a temperature of from 50° to 150° C. for from 30 seconds to 10 minutes. In the case of curing with ultraviolet rays, irradiation is preferably conducted by an ultraviolet lamp of 80 W/cm from a distance of about 10 cm for from 5 seconds to 1 minute. Particularly preferred is curing by ultraviolet rays or by electron beams.

With respect to the surface of the heat resistant lubricating layer, it is necessary that the round particles are projecting from the standard surface. The height of the portions projected from the standard surface is suitably from 0.5 to 5 $\mu$m. In the present invention, the standard surface is the surface 4 constituted by the fine particles present on the surface of the heat resistant lubricating layer, as shown in FIG. 1.

The surface of the heat resistant lubricating layer thus formed preferably has a surface density by number of the round particles projecting from the standard surface of the heat resistant lubricating layer of from $1.0\times10^9$ particles/m$^2$ to $5.0\times10^{11}$ particles/m$^2$, more preferably from $5.0\times10^9$ particles/m$^2$ to $1.0\times10^{11}$ particles/m$^2$, as observed by SEM.

The base film in the heat transfer sheet of the present invention may be a polyethylene terephthalate film, a polyamide film, a polyaramide film, a polyimide film, a polycarbonate film, a polyphenylene sulfide film, a polysulfone film, a cellophane film, a triacetate film or a polypropylene film. Among them, a polyethylene terephthalate film is preferred from the viewpoint of the mechanical strength, the dimensional stability, the heat resistance and the price. A biaxially stretched polyethylene terephthalate film is more preferred. The thickness of such a base film is preferably from 1 to 30 $\mu$m, more preferably from 2 to 15 $\mu$m.

The ink layer of the thermal transfer recording sheet of the present invention may be formed by a usual method. For example, in the case of the sublimation type thermal transfer recording sheet, a sublimable dye and a heat resistant binder resin may be dissolved or dispersed in a suitable solvent to obtain an ink, and this ink is coated on the base film, followed by drying. In the case of the melting thermal transfer recording sheet, a coloring matter such as a pigment or a dye is dissolved or dispersed in a heat-meltable substance, if necessary, by means of a solvent, to obtain an ink, and this ink is coated on the base film, followed by drying. As the sublimable dye to be used for the above sublimation type thermal transfer recording sheet, non-ionic azo dyes, anthraquinone dyes, azomethine dyes, methine dyes, indoaniline dyes, naphthoquinone dyes, quinophthalone dyes or nitro dyes may be mentioned. As the binder resin, a polycarbonate resin, a polysulfone resin, a polyvinylbutyral resin, a polyarylate resin, a polyamide resin, a polyaramide resin, a polyimide resin, a polyetherimide resin, a polyester resin, an acrylonitrile-styrene resin as well as cellulose resins such as acetyl cellulose, methyl cellulose and ethyl cellulose, may, for example, be mentioned. As the solvent, an organic solvent such as toluene or xylene, a ketone solvent such as methyl ethyl ketone, methyl isobutyl ketone or cyclohexanone, an ester solvent such as ethyl acetate or butyl acetate, an alcohol solvent such as isopropanol, butanol or methyl cellosolve, a halogenated solvent such as methylene chloride, tirchloroethylene or chlorobenzne, an ether solvent such as dioxane or tetrahydrofuran, or an amide solvent such as dimethylformamide or N-methylpyrrolidone, may be employed.

As the colorant to be used for the melting type thermal transfer recording sheet, the pigment includes, for example, an inorganic pigment such as carbon black, and various organic pigments of azo type or condensed polycyclic type, and the dye includes, for example, acidic dyes containing sulfonic acid groups, basic dyes, metal complex dyes and oil soluble dyes. Further, as the heat-meltable substance, a solid or semi-solid substance having a melting point of from 40° to 120° C. is preferred, such as carnauba wax, montan wax, microcrystalline wax, Japan wax or fat-type synthetic wax. As the solvent, those mentioned above with respect to the sublimation type thermal transfer recording sheet, may be employed. To the above described various inks, in addition to the above described components, various additives such as organic or inorganic non-sublimable fine particles, dispersants, antistatic agents, blocking-preventing agents, defoaming agents, antioxidants and viscosity controlling agents, may be incorporated, as the case requires.

Coating of such an ink may be conducted by the same methods as described above with respect to the coating of the heat resistant lubricating layer. The thickness of the coated film is preferably from 0.1 to 5 $\mu$m as the dried film thickness. Further, in the production of the recording sheet of the present invention, corona treatment may be applied to the surface of the base film in order to improve the adhesion of the base film and the layers formed thereon as described above, or primer coating treatment may be conducted by means of a resin such as a polyester resin, a cellulose resin, a polyvinyl alcohol, a urethane resin or a polyvinylidene chloride.

As an image-receiving record sheet (hereinafter referred to simply as a record sheet) to be used in combination with the thermal transfer recording sheet of the present invention, a record sheet commonly employed in a usual heat transfer recording system, can be used. Usually, the record sheet comprises a substrate and a color-forming layer formed on the surface of the substrate. To facilitate the feeding of the record sheet during the heat transfer recording, it is preferred to provide a backing layer on the rear side of the substrate. In some cases, an interlayer may be provided between the substrate and the color-forming layer, or between the substrate and the backing layer. Further, an overcoating layer may further be provided on the color-forming layer.

As the substrate, various papers made of cellulose fibers or various synthetic papers or plastic films made of synthetic resins, may be mentioned. The substrate may also be a laminate of such materials with an adhesive layer or a releasing layer interposed therebetween.

The color-forming layer is a layer which receives a colorant transferred from the thermal transfer recording sheet and forms an image, and it is formed usually by employing a thermoplastic resin having good affinity with a colorant, as the main component. For example, a linear saturated polyester resin, an acrylic resin and a vinyl resin such as polyvinyl chloride or polyvinyl acetate, are preferred since they are excellent in the affinity with colorants.

The color-forming layer usually contains various releasing agents or inorganic or organic fine particles in order to improve the releasing properties of the record sheet from the color sheet after the transfer recording. The color-forming layer may contain in addition to the above components further additives such as an ultraviolet absorber, a photostabilizer, an antioxidant, a fluorescent brightener and an antistatic agent, as the case requires.

To the record sheet, treatment may be applied to make it writable. The record sheet may further have markings for positioning.

With the thermal transfer recording sheet of the present invention, the running properties are excellent without sticking by fusion of the thermal head even during high energy recording, and the function of cleaning the thermal head is excellent and the thermal head can be maintained in a clean state, whereby transfer recording with an excellent image quality can be obtained.

Now, the present invention will be described in further detail with reference to Examples. However, it should be understood that the present invention is by no means restricted by such specific Examples. In these Examples, "parts" means "parts by weight".

EXAMPLE 1

(a) Preparation of a thermal transfer recording sheet

Using a biaxially stretched polyethylene terephthalate film (thickness: 4 μm) as the base film, a coating solution having the following composition was coated in a wet film thickness of about 10 μm on one side of the film, then dried and treated by a high pressure mercury lamp with an energy of 80 W/cm with a distance between the mercury lamp and the film being 115 mm for an irradiation time of 20 seconds for a curing reaction to form a heat resistant lubricating layer.

| Composition of the coating solution | | | |
|---|---|---|---|
| (1) | Dipentaerythritol hexaacrylate compound | KAYARAD DPHA (Tradename, manufactured by Nippon Kayaku K.K.) | 7.5 parts |
| (2) | Epoxy acrylate compound | "RIPOXY SP-1509" (tradename, manufactured by Showa Kobunshi K.K.) | 7.5 parts |
| (3) | Ethyl acetate | | 60 parts |
| (4) | Isopropyl alcohol | | 20 parts |
| (5) | Fine silica particles | "AEROSIL R972" (tradename, manufactured by Nippon Aerosil K.K.) | 2 parts |
| (6) | Spherical silicone particles | "TOSPEARL 120" (tradename, manufactured by Toshiba Silicone K.K.) | 1 part |
| (7) | Photopolymerization initiator | "Darocure 1173" (tradename, manufactured by Merck Co.) | 1 part |
| (8) | Silicone surfactant | "NUC silicone L7602" manufactured by Nippon Yunika K.K. | 1 part |

On the back side of the heat resistant lubricating layer of the above film, an ink comprising 5 parts of a sublimable dye (C.I. Solvent Blue 95), 10 parts of a polysulfone resin and 85 parts of chlorobenzene, was coated and dried to form an ink layer having a thickness of about 1 μm, to obtain a thermal transfer recording sheet.

In the above coating solution, "TOSPEARL 120" is spherical particles having an average particle size of 2 10 μm, and "AEROSIL R972" is fine particles with an average particle size of the primary particles being 16 mμm.

The thickness of the above heat resistant lubricating layer is about 18 μm as the thickness to the standard surface, and it was observed by a microscopic observation that round particles are projecting on the standard surface.

(b) Preparation of an image-receiving sheet

A liquid comprising 10 parts of a saturated polyester resin ("TR-220", tradename, manufactured by Nippon Gosei K.K.), 0.5 part of an amino-modified silicone ("KF-393", tradename, manufactured by Shin-Etsu Kagaku Kogyo K.K.), 15 parts of methyl ethyl ketone and 15 parts of xylene, was coated on a synthetic paper ("YUPO FPG 150", tradename, manufactured by Oji Yuka K.K.) by a wire bar, then dried (dried film thickness: about 5 μm) and further subjected to heat treatment in an oven at 100° C. for 30 minutes to obtain an image-receiving sheet.

(c) Results of the transfer recording

The recording sheet and the image-receiving sheet prepared as described above, were put together so that the ink layer of the recording sheet was in contact with the resin-coated side of the image-receiving sheet, and an electric power of 0.4 W/dot was applied to the heat resistant layer side of the recording sheet for 10 msec by a thermal head having a heat generating resistor density of 8 dot/mm to conduct transfer recording of 200 cm at a density of 8 lines/mm. As a result, the sheet ran smoothly without a sticking noise and without fusion or sticking of the sheet to the head, to obtain an excellent transfer record. After the recording, the surface of the head was inspected, and no deposition was observed.

EXAMPLES 2 to 8

Various thermal transfer recording sheets were prepared in the same manner as in Example 1 except that various coating solutions as identified in Table 1 were used as coating solutions for forming the heat resistant lubricating layers and the heat resistant layers having the thicknesses as identified in Table 1 were formed.

Using each transfer recording sheet thus obtained and an image-receiving sheet prepared in the same manner as in Example 1, transfer recording was conducted in the same manner as in Example 1. As a result, in each case, the sheet ran smoothly without a sticking noise or without fusion or sticking of the sheet to the head, to obtain an excellent transfer recording. After the recording, the surface of the head was inspected, and no deposition was observed.

TABLE 1

| Example No. | Coating solution for the heat resistant lubricating layer | Wet coating thickness | Heat resistant lubricating layer thickness |
|---|---|---|---|
| 2 | Same as Example 1 except that spherical particles "TOSPEARL 130"*1 was used instead of "TOSPEARL 120". | 15 μm | 2.7 μm |
| 3 | Same as Example 1 except that fine titanium oxide particles "P25"*2 were | 10 μm | 1.8 μm |

TABLE 1-continued

| Example No. | Coating solution for the heat resistant lubricating layer | Wet coating thickness | Heat resistant lubricating layer thickness |
|---|---|---|---|
| | used instead of fine silica particles "AEROSIL R-972". | | |
| 4 | Same as Example 1 except that the amount of spherical particles "TOSPEARL 120" was changed to 3 parts. | 10 μm | 1.9 μm |
| 5 | Same as Example 1 except that the amount of spherical particles "TOSPEARL 120" was changed to 3 parts, and the amount of fine silica particles "AEROSIL R-972" to 4 parts. | 10 μm | 2.0 μm |
| 6 | Same as Example 1 except that "RIPOXY SP-4010"*3 was used instead of ultraviolet curable resin "RIPOXY SP-1509". | 10 μm | 1.8 μm |
| 7 | Same as Example 1 except that "KAYARAD D-310"*4 was used instead of ultraviolet curable resin "KAYARAD DPHA". | 10 μm | 1.8 μm |
| 8 | Same as Example 2 except that the amount of the fine silica particles "AEROSIL R-972" in Example 2 was changed to 3 parts. | 15 μm | 2.8 μm |

Notes in Table 1

*1Tradename, fine spherical silicone resin particles, average particle size: 3 μm, manufactured by Toshiba Silicone K.K.

*2Tradename, fine titanium oxide particles, average particle size of primary particles: 21 nm, manufactured by Nippon Aerosil K.K.

*3Tradename, epoxyacrylate compound, manufactured by Showa Kobunshi K.K.

*4Tradename, dipentaerythritol hexaacrylate compound, manufactured by Nippon Kayaku K.K.

COMPARATIVE EXAMPLE 1

A thermal transfer recording sheet was prepared in the same manner as in Example 1 except that in the coating solution for forming the heat resistant lubricating layer, spherical particles "TOSPEARL 120" and fine silica particles "R-972" were omitted. Using this thermal transfer recording sheet, transfer recording was conducted in the same manner as in Example 1.

As a result, a sticking noise was substantial, and the sheet did not run smoothly during the recording.

COMPARATIVE EXAMPLE 2

A thermal transfer recording sheet was prepared in the same manner as in Example 1 except that in the coating solution for forming the heat resistant lubricating layer, silica particles "R-972" were not used. Using this thermal transfer recording sheet, transfer recording was conducted in the same manner as in Example 1.

As a result, a sticking noise was small during the recording, and the sheet ran smoothly. But, in the course of recording, irregular color formation was observed on the recorded image. After the recording, the thermal head surface was inspected, and deposition of dusts such as cellulose fibers on the surface was observed.

We claim:

1. A thermal transfer recording sheet comprising a base film, a heat transferable ink layer formed on one side of the base film and a heat resistance lubricating layer formed on the other side of the base film, wherein said heat resistance lubricating layer comprises round particles, fine particles having a particle size smaller than that of the round particles and a heat resistant binder resin, as the main components, and the round particles are projecting from the standard surface of the heat resistant lubricating layer, wherein the particle size distribution of the round particles is substantially within the range of from 0.5 to 5 μm, wherein the particle size distribution of the fine particles is substantially within the range of from 0.01 to 0.1 μm, and wherein the average particle size of the fine particles is at most 1/10 of the average particle size of the round particles.

2. The thermal transfer recording sheet according to claim 1, wherein the round particles are in an amount of from 1 to 50 parts by weight per 100 parts by weight of the binder resin.

3. The thermal transfer recording sheet according to claim 1, wherein the fine particles are in an amount of from 5 to 100 parts by weight per 100 parts by weight of the binder resin.

4. The thermal transfer recording sheet according to claim 1, wherein the round particles re made of a material selected from the group consisting of a silicone resin, silica or a benzoguanamine resin.

5. The thermal transfer recording sheet according to claim 1, wherein the fine particles are made of a material selected from the group consisting of silica and titanium oxide.

6. The thermal transfer recording sheet according to claim 1, wherein the surface density by number of the round particles at the surface of the heat resistant lubricating layer is within a range of from $1.0\times10^9$ particles/m$^2$ to $5.0\times10^{11}$ particles/m$^2$.

7. The thermal transfer recording sheet according to claim 1, wherein the surface density by number of the round particles at the surface of the heat resistant lubricating layer is within a range of from $5.0\times10^9$ particles/m$^2$ to $1.0\times10^{11}$ particles/m$^2$.

8. The thermal transfer recording sheet according to claim 1, wherein the particle size of the round particles is larger than the thickness of the heat resistant lubricating layer.

* * * * *